United States Patent [19]

Grimaldo

[11] 4,206,629

[45] Jun. 10, 1980

[54] BACK SHOE FOR A TUBE BENDER

[75] Inventor: Samuel Grimaldo, Thousand Oaks, Calif.

[73] Assignee: American Machine & Hydraulics, Inc., Newbury Park, Calif.

[21] Appl. No.: 17,712

[22] Filed: Mar. 5, 1979

[51] Int. Cl.[2] ..... B21D 7/06

[52] U.S. Cl. ..... 72/389

[58] Field of Search ..... 72/389, 386, 384, 380, 72/369, 320, 319, 298

[56] References Cited

U.S. PATENT DOCUMENTS

| | | | |
|---|---|---|---|
| 3,499,309 | 3/1970 | Gregg | 72/389 |
| 3,756,058 | 9/1973 | Hamkins | 72/389 |

FOREIGN PATENT DOCUMENTS

| | | | |
|---|---|---|---|
| 1065945 | 5/1954 | France | 72/389 |
| 7008050 | 12/1970 | Netherlands | 72/389 |

*Primary Examiner*—Francis S. Husar
*Assistant Examiner*—Gene P. Crosby
*Attorney, Agent, or Firm*—Ralph B. Pastoriza

[57] ABSTRACT

The back shoe is made up of half block sections hinged together so that when in axial alignment, they function as a conventional back shoe on a tube bender. By hinging the two block halves, one half may be swung upwardly and over the other so that only one half the normal axial length of the cylindrical cavity engaging a side of a pipe results. As a consequence, it is possible to make a second bend in a tube close to a first bend without interference with the back shoe as would be the case were a back shoe of conventional length used. Essentially, the invention provides a single back shoe which serves a dual function so that labor time is saved in tube bending operations.

2 Claims, 6 Drawing Figures

BACK SHOE FOR A TUBE BENDER

This invention relates generally to tube benders and more particularly to an improved back shoe for use with a conventional tube bender.

BACKGROUND OF THE INVENTION

Conventional tube benders of the type under consideration include first and second spaced back gates receiving back shoes. Each of these back shoes comprises a block having a cylindrical cut-out on one side of given axial length for engaging a side wall portion of one side of a tube to be bent. A radiused ram in turn is positioned to engage against an opposite central side wall of the tube when urged along an axis passing between the back gates and back shoes. The back gates and shoes supported thereon are swingable in opposite directions as the ram die moves along the axis between the back gates to thereby form a bend in the tube.

When tubes of different diameter are to be bent, it is necessary to change the back shoes to provide shoes with cylindrical cut-outs conforming to the cylindrical outside diameter of the tube in question. The axial length of the cut-out in each shoe may vary depending upon the diameter of the tube and normally there is an optimum relationship for effecting proper yielding during the bending operation of the material of the tube to form a proper bend.

In certain types of tube bending operations such as in forming exhaust pipes for automobiles, first and second bends in the tube must oftentimes be made relatively close together. With the conventional back shoes, the axial length of the cylindrical cut-out engaging side portions of the tube is such that a second bend cannot be made as close to a first bend as required. The reason is that the length of the shoe is such as to interfere with the first bend in initially positioning the pipe for the second bend. In other words, there must be a certain amount of spacing between the first and second bend in order that the shoes can properly engage the tube side walls to form the second bend.

Under the foregoing circumstances, an operator must remove one of the standard conventional shoes and insert one having the same cylindrical cut-out diameter but of shorter axial length so that the second bend can be made correspondingly closer to the first bend without interference with the shoe. After such second bend is made, and normal bending operations are to resume, the operator will remove the shorter shoe and insert a conventional shoe for the remaining bends which are normally spaced a sufficient distance apart that the conventional shoes can be used.

BRIEF DESCRIPTION OF THE PRESENT INVENTION

With the foregoing considerations in mind, the present invention contemplates the provision of an improved back shoe construction which can be substituted for a conventional back shoe and utilized in making tube bends in a normal manner. The construction of the improved shoe of this invention, however, is such that a half portion thereof can be folded to an out-of-the-way position to enable making of a second bend which must be closer to the first bend than would be possible with a conventional shoe. In other words, the improved shoe of this invention is capable of performing two functions with a single structure with consequent savings in labor time.

Briefly, the improved shoe comprises two blocks in side-by-side positions, each block having a cylindrical cut-out of one half the normal given axial length of a conventional shoe cut-out so that the overall axial length of both cut-outs is the same as the normal axial length. Coupling means such as a hinge is provided so that one of the blocks can be moved out of alignment with the other to leave a cylindrical cut-out tube engaging surface of one half the axial length of the conventional shoe cut-out. A second bend can be made closer to the first bend on a tube without interference with the improved back shoe than is possible with a conventional back shoe.

BRIEF DESCRIPTION OF THE DRAWINGS

A better understanding of this invention will be had by referring to the accompanying drawings in which.

DETAILED DESCRIPTION OF THE PREFERRED EMBODIMENT

Figure 1:
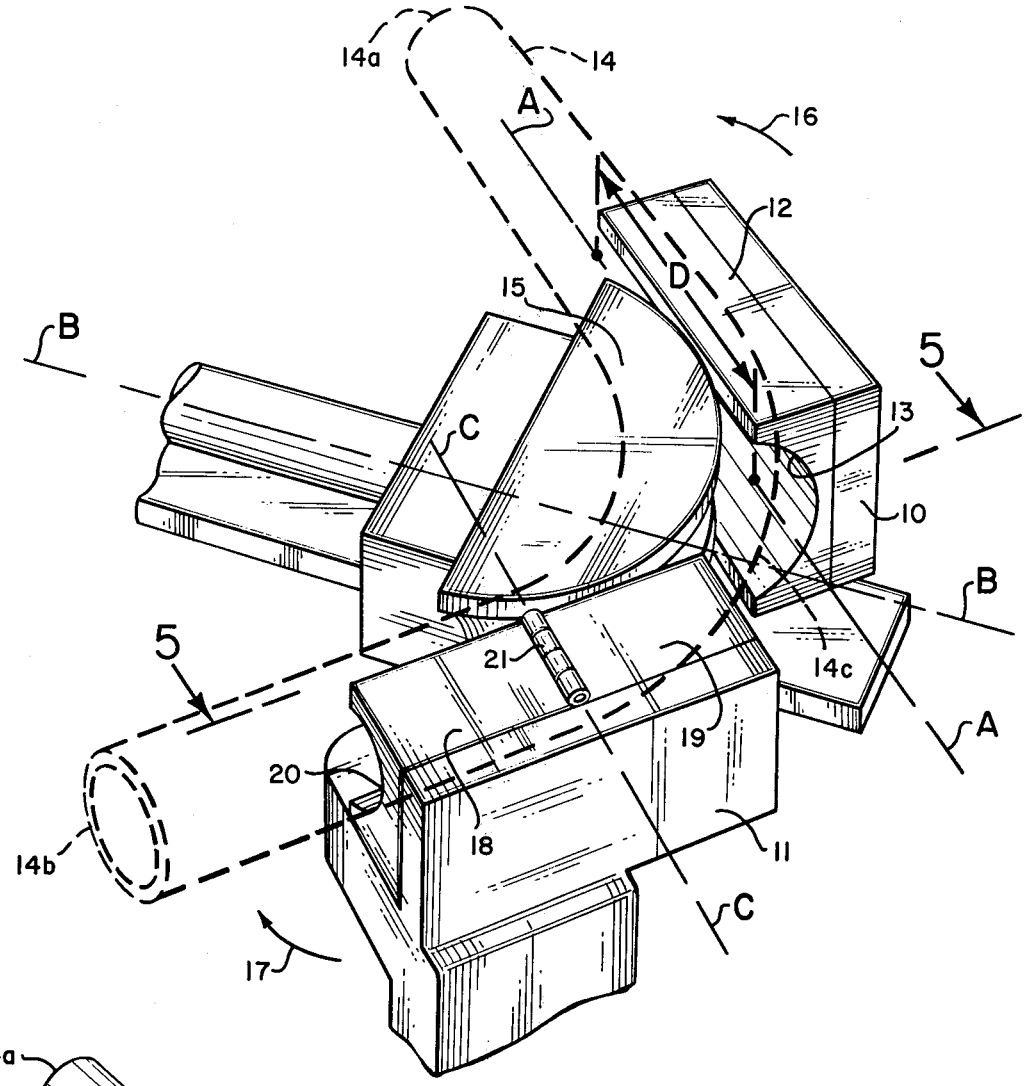
FIG. 1 is a highly diagramatic perspective view of the basic components of a conventional tube bender wherein the shoe of the present invention has been substituted for one of the conventional shoes of the bender.

Referring first to FIG. 1, the tube bender shown comprises first and second spaced back gates 10 and 11 for receiving conventional back shoes one of which is shown at 12 seated on the gate 10. Each of such conventional type back shoes comprises a block having a cylindrical cut-out such as indicated at 13 for the shoe 12 on one side of given axial length D as measured along the axis A—A of the cylindrical cut-out. The cylindrical cut-out surface defined is dimensioned to engage in substantially full surface contact a side wall portion of one side of a tube indicated in phantom lines at 14 in FIG. 1.

A radiused ram 15 is positioned to engage against an opposite central side wall of the tube 14 when urged along an axis B—B passing between the back gates 10 and 11. Each of these back gates and the shoes received therein is swingable in opposite directions as the ram die 15 moves along the axis between the back gates as indicated by the arrows 16 and 17 respectively. It can thus be appreciated that the tube is formed into a smooth bend about the radiused die 15 as the same is moved further between the back gates.

Still referring to FIG. 1, there is shown on the back gate 11 the improved shoe of the present invention in the form of two blocks 18 and 19 each having cylindrical cut-outs, one of which is visible at 20 for the block 18. As shown, the two blocks are in side-by-side positions and are so dimensioned that the overall axial length of the cut-outs is the same as the given axial length D for the cylindrical cut-out in the conventional back shoe 12 described in FIG. 1. An appropriate coupling means preferably in the form of a hinge 21 secured to adjacent top edges of the blocks 18 and 19 is provided as shown. The hinge axis indicated at C—C in FIG. 1 is transverse to and above the axis of the cylindrical cut-out 20 and the arrangement permits movement of one block such as the block 18 to an out-of-alignment position with the other block 19 the purpose for which will all become clearer as the description proceeds.

To best illustrate the operation of the present invention, the phantom line tube 14 depicted in FIG. 1 is to have two bends made therein relatively close together. For purposes of identifying the orientation of the tube 14, its opposite ends have been indicated at 14*a* and 14*b* respectively in FIG. 1.

Figure 2:
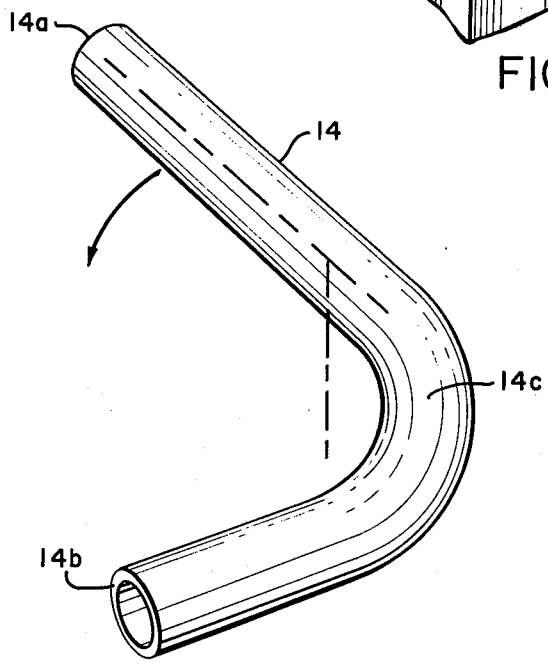
FIG. 2 is a perspective view of a tube in which a first bend has been formed by the bender of FIG. 1.

Referring now to FIG. 2, there is shown the tube 14 with a first bend having already been made by the set-up illustrated in FIG. 1. This first bend is illustrated at 14*c* and may, for example, be a 90° bend.

Figure 3:
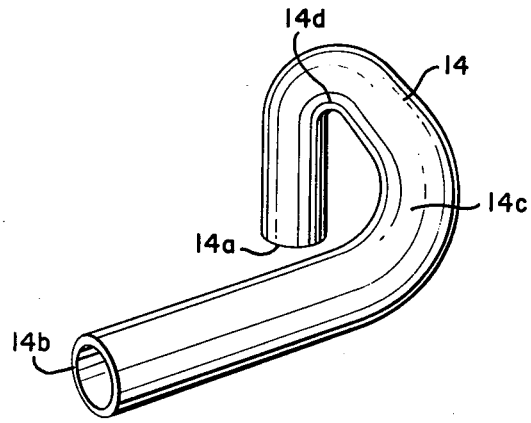
FIG. 3 illustrates a second bend to be made in the tube of FIG. 2.

Assume now it is desired to make a second bend in the tube 14 relatively close to the first bend 14*c*, the second bend being in a different plane and resulting in the end portion 14*a* of the tube being bent downwardly as indicated by the arrow in FIG. 2 and as shown in full lines in FIG. 3. This second bend is illustrated at 14*d* in FIG. 3.

Figure 4:
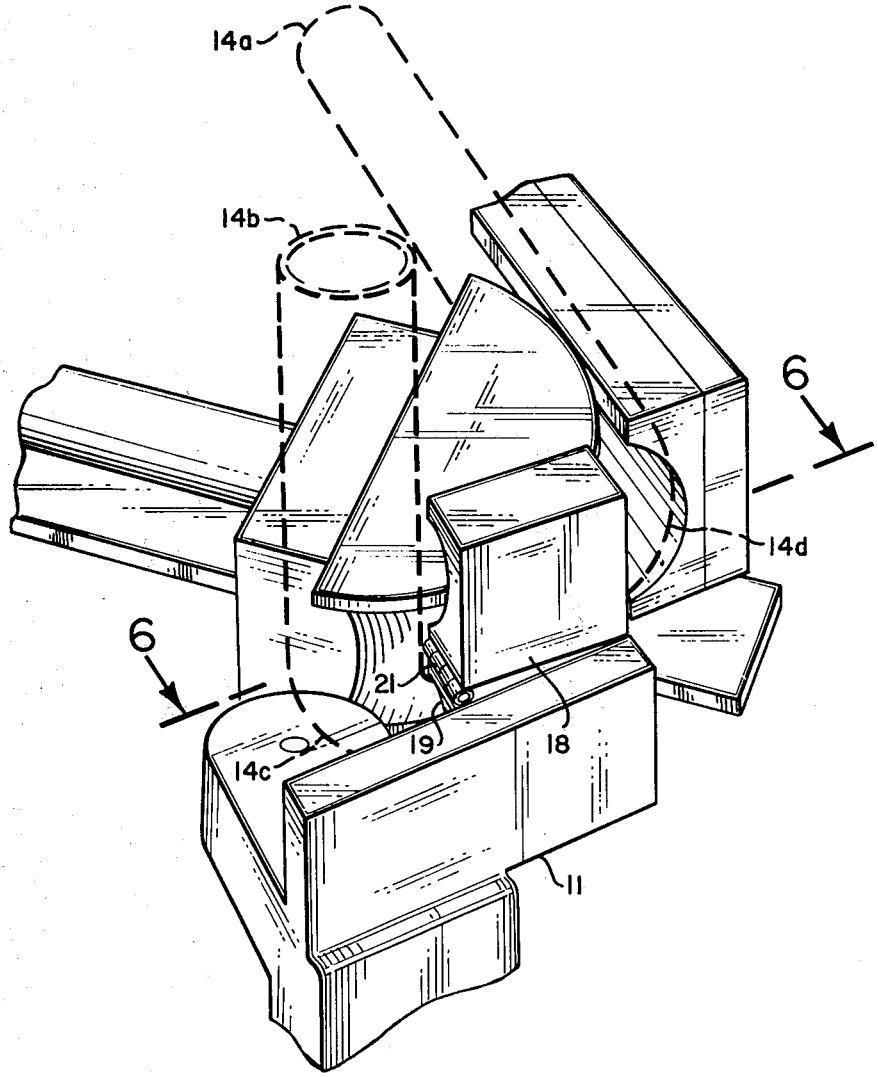
FIG. 4 is a view similar to FIG. 1 illustrating the making of the second bend depicted in FIG. 3 utilizing the shoe of the present invention.

To form the second bend 14*d* in the tube of FIG. 2 as shown in FIG. 3, the tube 14 is repositioned in the tube bender as illustrated in phantom lines in FIG. 4 with the end 14*b* pointing upwardly.

In FIG. 4, the bend is shown as essentially completed at the phantom lines 14*d*.

It can be appreciated from the phantom line showing in FIG. 4 that it would not be possible to position the tube 14 between the ram and the back shoes for effecting a bend at 14*d* without interference between the upwardly extending portion 14*b* and a conventional normal shoe received in the back gate 11. The reason is that the axial length of the cylindrical cut-out in the normal conventional shoe is too long and would interfere with the end portion 14*b* resulting from the first bend made in the tube.

However, by swinging the block 18 about the axis of the hinge 21 through 180° to overlie the block 19 as illustrated in FIG. 4, there results an axial length of the cut out one half the normal axial length of a conventional shoe so that there is now no interference with the bent tube end portion 14*b* of the tube 14.

It can be appreciated that after the second bend 14*b* is formed in the tube, the block 18 may be swung back downwardly into alignment with the block 19 to provide a normal cylindrical length portion for engagement of a side wall of the tube in effecting further bends.

The one improved shoe of this invention thus serves a dual function and avoids the necessity of an operator having to remove a shoe and insert a specially designed shorter shoe for effecting a second bend wherein such second bend is sufficiently closer to a first bend as to cause interference with a conventional sized shoe.

Figure 5:
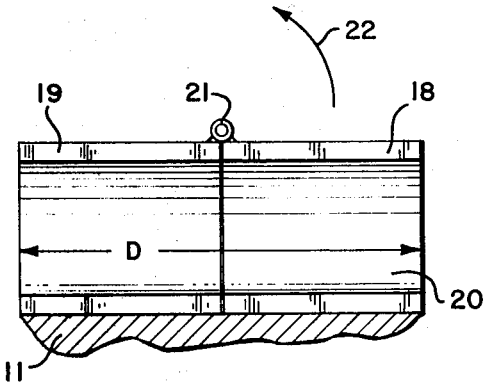
FIG. 5 is a front elevational view of the improved back shoe of this invention taken in the direction of the arrows 5—5 of FIG. 1 showing the shoe portions in aligned position; and, FIG. 6 is a view similar to FIG. 5 but looking in the direction of the arrow 6—6 of FIG. 4 showing the shoe portions in a second out-of-alignment position.
Figure 6:
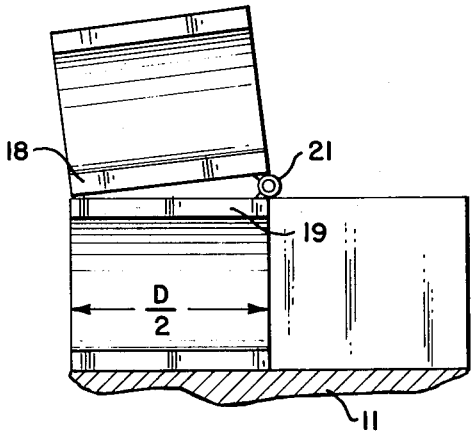

FIGS. 5 and 6 show the shoe blocks 18 and 19 in aligned and out-of-aligned positions respectively. While any appropriate coupling means may be provided, the simple hinge 21 permitting swinging of one block such as the block 18 through 180° to overlie the other block at 19 appears to be the simplest construction and constitutes applicant's preferred embodiment.

From all of the foregoing, it will be seen that the present invention has provided an improved back shoe for use with conventional tube bending equipment resulting in an overall saving of an operator's time, all to the end that tube bending operations can be speeded up.

I claim:

1. In a tube bender in which first and second spaced back gates receive conventional back shoes each comprising a block having a cylindrical cut-out on one side of given axial length for engaging, respectively, axially spaced side wall portions of one side of a tube and wherein a radiused ram is positioned to engage against an opposite central side wall of the tube when urged along an axis passing between the back gates, the back gates being swingable in opposite directions as the ram die moves along said axis between the back gates to thereby form a bend in the tube, an improved back shoe for substitution for one of said conventional back shoes, comprising, in combination:

(a) two blocks in side-by-side positions, each block having a cylindrical cut-out of one half said given axial length so that the overall axial length of both cut-outs is the same as said given axial length of the cut-out in said conventional shoe, and (b) coupling means for said blocks such that one of said blocks can be moved out of alignment with the other to leave a cylindrical cut-out tube engaging surface of one half the axial length of the conventional shoe cut-out to thereby enable a second bend closer to said first bend to be formed in said tube without interference with said improved shoe than is possible with a conventional back shoe.

2. An improved back shoe according to claim 1, in which said coupling means comprises a hinge secured to the top adjacent edges of said block, said hinge having a hinge axis transverse to and above the axis of said cut-outs so that movement of said one block out of alignment with the other is accomplished by swinging said one block upwardly about said hinge axis through 180° to overlie the other block.

* * * * *